US012065277B2

(12) United States Patent
Telman

(10) Patent No.: US 12,065,277 B2
(45) Date of Patent: Aug. 20, 2024

(54) SELF-SEALING FOLDABLE CONTAINER

(71) Applicant: Brook & Whittle Limited, Guilford, CT (US)

(72) Inventor: Christopher Telman, Wilmington, NC (US)

(73) Assignee: Brook & Whittle Limited, Guilford, CT (US)

( * ) Notice: Subject to any disclaimer, the term of this patent is extended or adjusted under 35 U.S.C. 154(b) by 0 days.

(21) Appl. No.: 18/115,575

(22) Filed: Feb. 28, 2023

(65) Prior Publication Data

US 2023/0373675 A1 Nov. 23, 2023

Related U.S. Application Data

(63) Continuation of application No. 17/019,206, filed on Sep. 12, 2020, now Pat. No. 11,591,125, which is a continuation-in-part of application No. 15/651,404, filed on Jul. 17, 2017, now Pat. No. 10,807,760, which is a continuation-in-part of application No. 15/348,016, filed on Nov. 10, 2016, now abandoned.

(51) Int. Cl.

| | |
|---|---|
| ***B65D 5/02*** | (2006.01) |
| ***B65B 7/20*** | (2006.01) |
| ***B65B 51/06*** | (2006.01) |

(52) U.S. Cl.

CPC ..... *B65B 51/067* (2013.01); *B65B 7/20* (2013.01); *B65D 5/0236* (2013.01)

(58) Field of Classification Search

CPC ..... B65D 5/0236; B65D 63/1009; B65D 2255/06; B65D 2313/08; B65D 27/14; G09F 3/0288; G09F 3/10; G09F 3/0292; B42D 15/006; B65B 51/067; B65C 1/02

USPC ..... 229/123.1, 125.39, 132, 136, 921, 102, 229/74; 283/81; 53/419; 206/813; 428/202, 41.8, 42.3; 40/630, 638; 493/382, 961

See application file for complete search history.

(56) References Cited

U.S. PATENT DOCUMENTS

| | | | | | |
|---|---|---|---|---|---|
| 1,364,225 | A | | 1/1921 | John | |
| 2,052,977 | A | | 9/1936 | Hoffman | |
| 2,063,999 | A | | 12/1936 | Harrison | |
| 2,078,446 | A | * | 4/1937 | Grigg | B65D 5/6664 524/21 |
| 3,276,664 | A | * | 10/1966 | Johnson | B65D 5/0227 229/917 |
| 3,302,857 | A | | 2/1967 | Martin | |
| 3,306,521 | A | | 2/1967 | Giacovas | |
| 4,066,167 | A | * | 1/1978 | Hanna | B65D 75/5805 383/62 |
| 4,821,487 | A | * | 4/1989 | James | B65D 63/1009 53/136.4 |

(Continued)

*Primary Examiner* — Christopher R Demeree
(74) *Attorney, Agent, or Firm* — Blank Rome LLP

(57) ABSTRACT

A foldable container and method of storing adhesive in which a single strip of adhesive material is attached to a single release liner featured on a side surface or a flap of the foldable container. The strips of adhesive material can be peeled off a surface of the container and applied to and used to seal the top and bottom surfaces of the container as needed. The container features one or more release liner(s) each with a single strip of adhesive material attached only to the release liner and not a surface of the container itself.

8 Claims, 5 Drawing Sheets

(56) References Cited

U.S. PATENT DOCUMENTS

| | | | | |
|---|---|---|---|---|
| 5,184,997 | A * | 2/1993 | James | B65D 5/0236 53/136.4 |
| 5,465,900 | A * | 11/1995 | Baratto | B65D 5/4283 229/123.1 |
| 5,503,325 | A | 4/1996 | Nelson et al. | |
| 5,735,549 | A | 4/1998 | Konkol et al. | |
| 6,112,928 | A | 9/2000 | Black et al. | |
| 8,590,774 | B1 * | 11/2013 | Sauer | B65D 27/34 229/239 |
| 8,596,867 | B2 * | 12/2013 | Exner | B65D 33/18 383/211 |
| 8,602,214 | B2 * | 12/2013 | Raming | G09F 3/10 283/901 |
| 8,950,783 | B2 * | 2/2015 | Raming | G09F 3/0288 283/79 |
| 9,428,305 | B2 | 8/2016 | Cenzano et al. | |
| 9,580,202 | B2 | 2/2017 | Pettersson | |
| 2008/0073419 | A1 | 3/2008 | Kim et al. | |
| 2014/0319132 | A1 * | 10/2014 | Ram | B65D 5/0236 229/125.37 |
| 2015/0197364 | A1 | 7/2015 | Styema | |

* cited by examiner

SELF-SEALING FOLDABLE CONTAINER

CROSS-REFERENCE TO RELATED APPLICATIONS

This application is a Continuation of U.S. application Ser. No. 17/019,206, filed Sep. 12, 2023, which is a Continuation-in-Part of U.S. application Ser. No. 15/651,404, filed Jul. 17, 2017, issued Oct. 20, 2020 as U.S. Pat. No. 10,807,760, which is a Continuation-in-Part of U.S. application Ser. No. 15/348,016 filed on Nov. 10, 2016, now abandoned. The contents of U.S. patent application Ser. No. 15/651,404 filed on Jul. 17, 2017 and U.S. patent application Ser. No. 15/348,016 filed on Nov. 10, 2016 are incorporated by reference in their entirety.

BACKGROUND OF THE INVENTION

(a) Field of the Invention

This disclosure concerns the technical field of packaging. More particularly, this disclosure relates to a novel method of storing adhesive with packaging material with which it may be used. This disclosure also relates to a foldable container, such as a cardboard box, that comes with the means to seal the container without the use of a separate supply of tape or other adhesive.

(b) Background Art

Nothing stirs dread in the American heart as much as having to pack and/or move one's personal possessions to another location. Individuals and businesses across the globe use a variety of foldable containers to, temporarily or permanently, store tangible property, but arguably the most common foldable container is the cardboard box. The typical cardboard box is sold as a flattened structure that can be opened and folded into a three-dimensional box with a top and bottom surface capable of being opened and closed and/or sealed closed.

While the structure of a foldable container, such as, but not limited to a cardboard box, is not something that needs to be detailed in this application, a brief description of such a foldable container will simplify the forthcoming disclosure. The typical cardboard box has four side surfaces each with sets of flaps that may be the same or different sizes. Generally, two of the sides will feature two smaller or "minor" flaps, one located at a first end or "top" of a side surface and another minor flap at a second end or "bottom" of the same side surface. In addition, there are two larger flaps, i.e. major flaps that are located at a first end or "top" of a side surface that does not feature minor flaps and another major flap located at a second end or "bottom" of that same side surface. As stated above, with some containers, the major and minor flaps will be the same sizes. The side surfaces featuring minor flaps are directly opposed to each other and are substantially parallel to each other when the container is folded into an assembled state. In this context, the term directly opposed side surfaces refers to side surfaces that are on opposite sides of the container when the container is opened and folded into a three-dimensional box. Substantially parallel in this context means that the structures being referred to are positioned in planes that are within two inches of being equidistant from each other at all points. In addition, the side surfaces featuring major flaps are directly opposed to each other and are substantially parallel to each other when the container is folded into an assembled state. The side surfaces featuring major flaps are also substantially perpendicular to the side surfaces featuring minor flaps. In this context, substantially perpendicular means that the structures referred to are positioned in planes that are either at right angles to each other or are at an angle of between 85.0 and 95.0 degrees to each other. As a result, when the flattened box structure is opened, the major and minor flaps can be folded over each other to form a top surface and/or a bottom surface of the box. Generally, the two minor flaps are folded down such that they are substantially perpendicular to the side surfaces of the box. Next the major flaps are folded down over the minor flaps producing a closed surface at either end of the container.

Sealing such a foldable container is generally accomplished by attaching an adhesive substance such as tape to one or more of the flaps after folding the flaps over each other to form a top or bottom surface of the container. Either an adhesive glue is attached to one or more of the surfaces of the flaps such that the adhesive will attach one flap to another when they are in contact; or more commonly, a strip of adhesive material, i.e. tape, is applied to the outside of the box after the flaps are folded down over one another. Generally, the adhesive material is placed over the free edges of the major flaps after they are folded over the minor flaps.

Sealing the box itself presents a handful of difficulties for which there is not an adequate solution in the prior art. More specifically, boxes and adhesive tape must be purchased separately and in quantities that never match. Anyone that has ever packed a significant amount of their property into cardboard boxes or similar containers has encountered the same situation, namely, that one either runs out of tape before all of the boxes have been sealed or one is left with a lot of leftover packing tape that has no other practical purpose other than sealing boxes. Moreover, applying the tape to the boxes in and of itself can present a handful of difficulties including but not limited to trying to remove the edge of the tape from the roll without tearing the tape unevenly, applying the tape to the box evenly without the tape adhering to itself, or unevenly tearing the tape off the roll of tape before applying the tape to the box. Last, but certainly not least, there is the difficulty inherent in storing packing materials separately, e.g., one may have boxes, but no available tape or vice versa.

The present disclosure describes a foldable container that will provide a consumer with an easy and affordable way to seal a foldable container without possessing a separate supply of adhesive. Inherent in this disclosure is not only a device that stores the proper amount of adhesive material with itself, but a method for doing the same and for using such a foldable container.

BRIEF SUMMARY OF THE INVENTION

While the preferred embodiments of the container are configured similar to the foldable container as described above, the container can be all shapes and sizes, whether foldable or not. Moreover, these embodiments can be used with a container that does not feature flaps. A previously disclosed embodiment of the method and container included a release liner fixed to one or more side surfaces or flaps of a container. Whether a side surface or a flap, or both, the same surface features one or more strips of adhesive material attached to a release liner. Other variations on this embodiment include more than one side surface featuring a single release liner or a plurality of release liners with one or more strips of adhesive material attached, and/or other surfaces of the box, i.e. the flaps featuring a release liner, with one or more strips of adhesive material attached. These embodiments include a release liner fixed to an outer surface of the container—the major or minor flaps for example—with strips of adhesive material fixed to the release liner not the container itself. In fact, the contemplated best mode of this invention is a foldable container with one or more release liners each sized to engage with a single strip of adhesive material attached said release liner.

To seal this particular embodiment of the container, a user generally assembles or unfolds the foldable container starting from its knock-down state. Next the user folds each of the minor flaps at one end of the foldable container such that they are substantially perpendicular to the side surfaces. Then the user folds the major flaps attached to the same end of the container such that they lay on top of the minor flaps. At that point, the container is ready to be sealed, i.e. a top or bottom surface has been created with the folded flaps. The process for sealing the top and bottom of the container are identical. The user removes a strip of adhesive material from the release liner(s) featured on the exterior of the foldable container and places that strip of adhesive material on the foldable container over the free edges of the flaps visible from the outside of the container and a portion of a first side surface of the foldable container. A second strip of adhesive material is then removed from a separate release liner featured on the exterior surface of the foldable container and placed on the foldable container over the free edges of the same flaps and a portion of a second or opposing side surface of the foldable container. Preferred variations of this embodiment include an overlapping portion of adhesive material. More specifically, the strips of adhesive material are placed such that one end of each strip of adhesive material overlaps with an end of the other strip of adhesive material forming an overlapping portion of adhesive material on the top or bottom surface of the container. This process is repeated with the other side of the foldable container to seal the opposing surface, i.e. the unsealed top or bottom, of the container using the other strips of adhesive material attached to a different portion of the exterior of the container.

These containers represent a method of storing adhesive material with the foldable container to which it will eventually be applied. Moreover, these containers represent a method of storing the correct amount of adhesive with a foldable container to which it will eventually be applied. Moreover, these containers represent a separate method of sealing a foldable container configured to store adhesive material. As discussed in detail below, the inventor has created a novel storage container that eliminates a number of the difficulties inherent in using a separate adhesive material to seal with container.

DETAILED DESCRIPTION OF THE INVENTION

Figure 1:
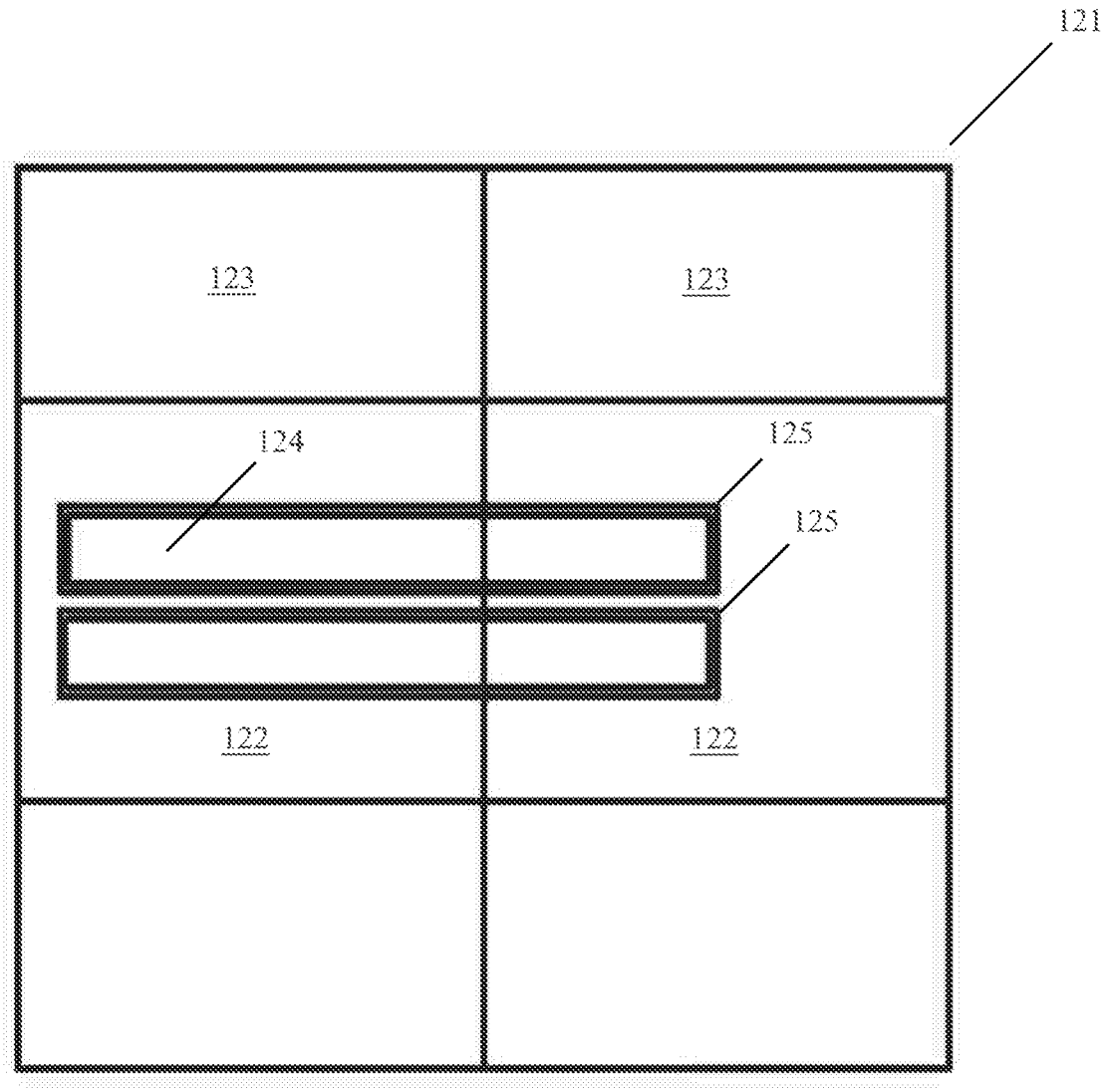
FIG. 1 is a top plan view of an embodiment of the foldable container prior to being sealed.
Figure 2:
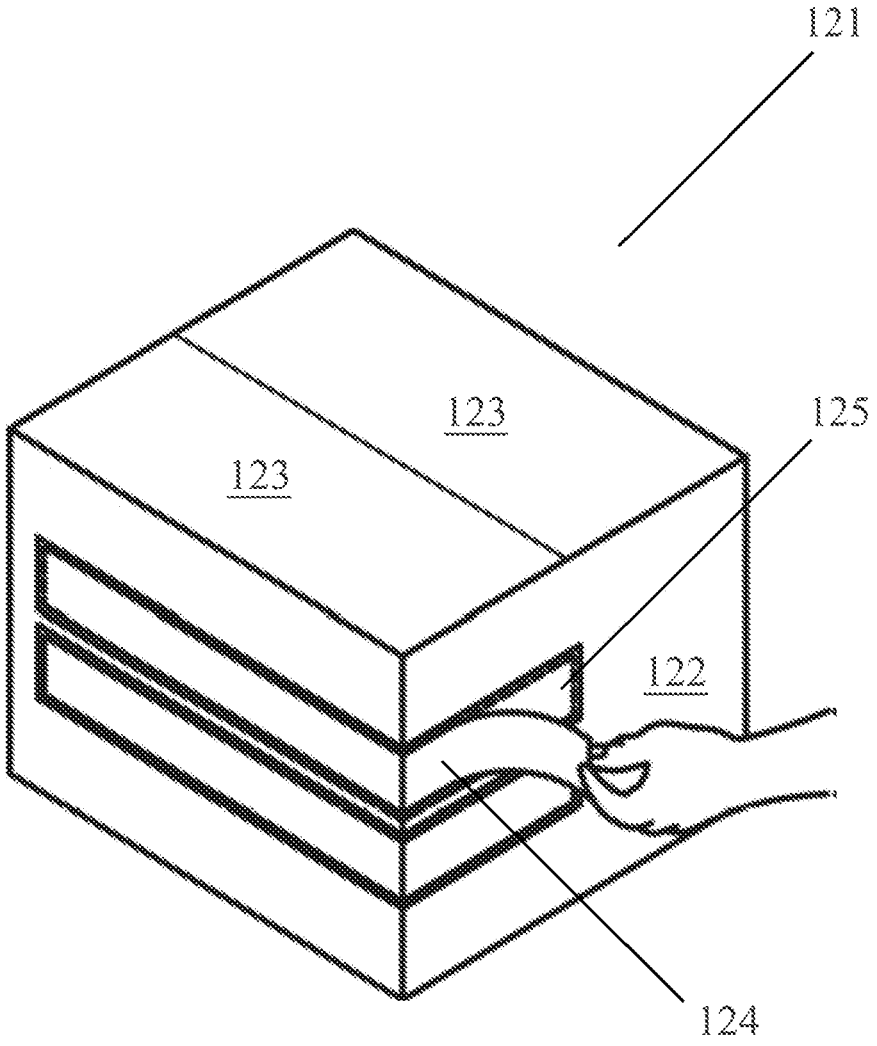
FIG. 2 is a top perspective view of the same container in closed, but unsealed state and demonstrating the removal of a strip of adhesive.
Figure 3:
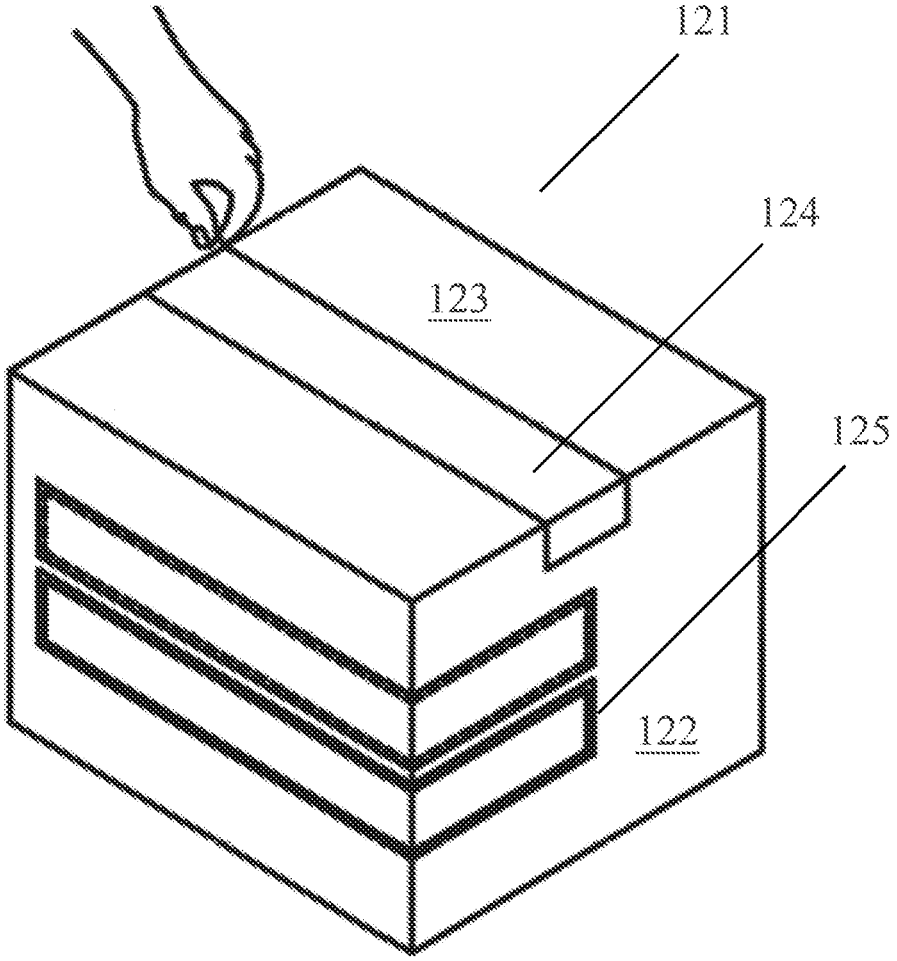
FIG. 3 is a top perspective view of the same container with the top sealed.
Figure 4:
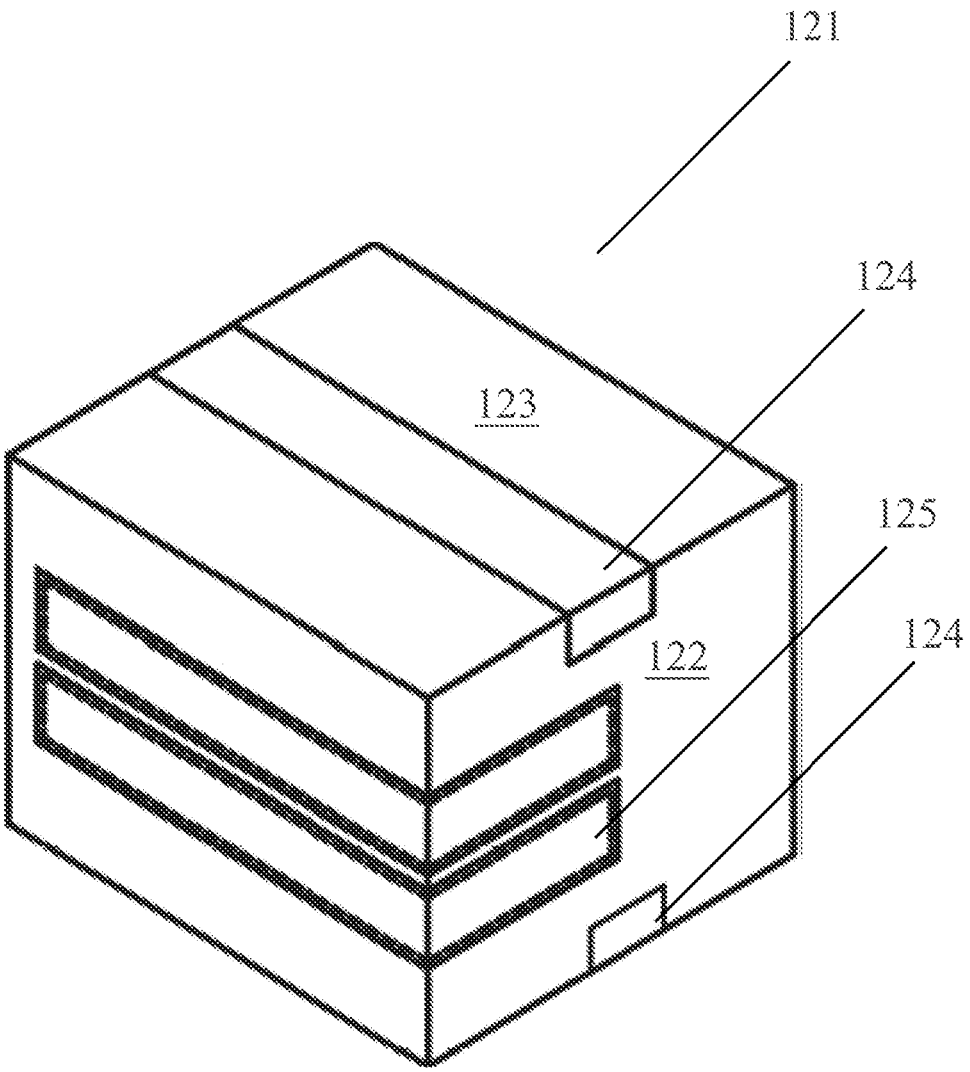
FIG. 4 is a top perspective view of the same container with the top and bottom sealed.
Figure 5:
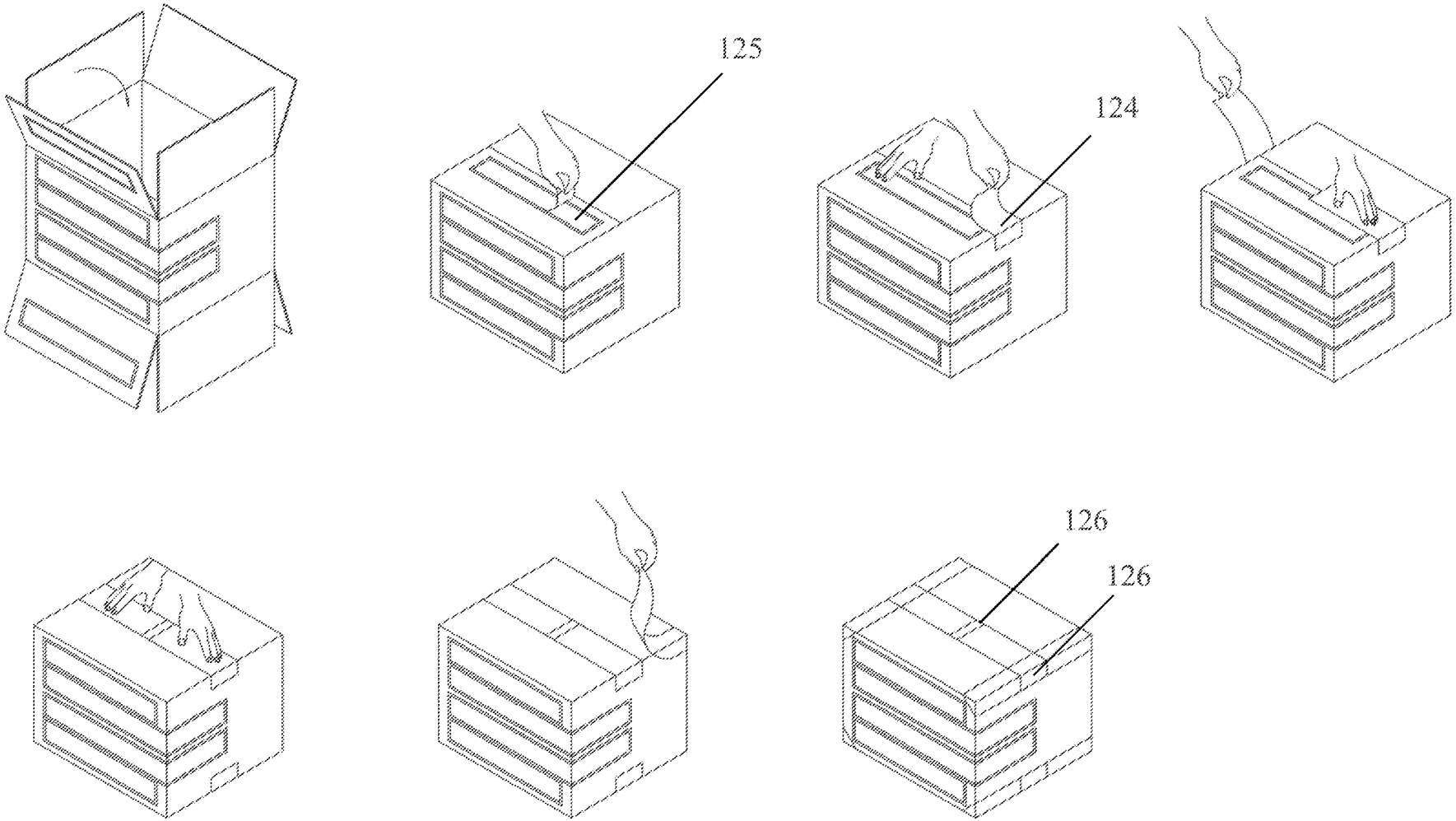
FIG. 5 is a flow chart showing the method of sealing a foldable container featuring the second embodiment of the container.

FIGS. 1-4 show a first version of the inventive foldable container 121 that includes two mid-ply release liners 125 attached to two side surfaces 122 of the container 121. Each release liner 125 has a single strip of adhesive material attached thereto. The method involves removing the strips of adhesive material 124 from the mid-ply release liner 125 and then placing each strip of adhesive material 124 over the folded flaps 123 that comprise the top and bottom of the sealed container 121. As a result, their initial placement does not dictate their final placement in any manner. A skilled artisan will realize that the mid-ply release liner 125 can be attached to any of the side surfaces 122 or the flaps 123 of the foldable container 121. Each foldable container 121 features a release liner 125 large enough to accommodate one strip of adhesive material 124. The strip(s) of adhesive material 124 can vary in size depending on the size of the release liner 125. Preferred embodiments of this foldable container 121 feature strips of adhesive material 124 that are five (5), six (6), seven (7), nine (9), ten and a half (10.5), twelve (12), thirteen (13) and fifteen (15) inches long. In addition, preferred embodiments of this foldable container 121 feature strips of adhesive material 124 that are two (2), three (3) and three and a half (3.5) inches wide. As shown in FIG. 5, the same container may feature different lengths of adhesive material 124.

In this version of the foldable container 121, a single side surface 122 or flap 123 can feature a mid-ply release liner 125 with a single strip of adhesive material 124; each strip of adhesive material 124 ideally being separated from the adjacent strip(s) of adhesive material by approximately one-eighth (⅛) of an inch, i.e. 0.125 inches. Other variations on this embodiment include more than one side surface 122 or flap 123 featuring a release liner 125 with one strip of adhesive material 124 attached to each release liner. Further, any surface of the container 121, i.e. the minor flaps or the major flaps can feature a release liner 125 with a strip of adhesive material 124 attached.

FIGS. 1-4 also show the steps in sealing a foldable container with this embodiment. FIGS. 1-4 show a perspective view of a foldable container 121 showing two flaps 123 and side surfaces 122. The foldable container 121 in FIGS. 1-4 features two separate release liners 125 extending over each of the two visible side surfaces 122. First, the minor flaps 123 are folded down such that they are substantially perpendicular to the side surfaces 122 of the foldable container 121. The user then folds the major flaps 123 down over the minor flaps (not shown) such that they are substantially perpendicular to the side surfaces 122 of the foldable container 121. At this point, the user has a foldable container with a top 126 or bottom surface 127 ready to be sealed. This same process is used to close and form the opposing top or bottom surface of the foldable container 121.

FIG. 5 shows a second embodiment of the presently disclosed container 121. In this embodiment, there are a plurality of release liners 125 featured on a single container 121. FIG. 5 shows a container 121 featuring six separate release liners 125 in two different sizes on a single container 121. Each strip of adhesive material 124 is attached to a single release liner 125. Some of the release liners 125 extend across more than one side surface of the container 121. As discussed above, other embodiments can feature one or more release liners 125 that extend across one of the flaps 123 and a side surface 122.

FIG. 5 is a flow chart that demonstrates the method of storing adhesive with packaging material as well as how to use the adhesive to seal the container 121. FIG. 5 shows a foldable container 121 open at both ends. Once the flaps are folded down on top of each other, the container 121 has a top surface and a bottom surface. Next the user peels a strip of adhesive material 124 off one of the mid-ply release liners 125 located on the container 121. After removing the strip of adhesive material 124 from one of the flaps 123 of the foldable container 121, the strip of adhesive material 124 is placed or laid over the top surface of the foldable container 121. As discussed previously, there are advantages to placing the strip(s) of adhesive material 124 over the free edges of the flaps 123, but the strips of adhesive material 124 can be placed in virtually any orientation over the surface(s) of the foldable container 121 that the user desires to seal. For example, strips of adhesive material 124 can be laid over the portion of the container 121 where the flaps 123 and side surfaces 122 meet as shown in FIG. 5.

If needed, the user removes a second strip of adhesive material 124 from another release liner 125 on the container 121. After removing the second strip of adhesive material 124 from the flap 123 of the foldable container 121, the strip of adhesive material 124 is placed or laid over a surface of the foldable container 121. As with previously described embodiments, each of the strips of adhesive material 124 can be placed such that they meet and form an overlapping portion 126 of adhesive material. This overlapping portion 133 often makes it easier to remove the strips of adhesive material 124 as it is easier to peel the adhesive material away from the back surface of the strip of adhesive material 124 than from the foldable container 121, especially when said container 121 is made of cardboard or other paper based material.

The user repeats these steps using the strips of adhesive material 124 attached to the release liner 125 located on the other flap 123 featuring the release liner 125 and strips of adhesive material 124 to seal the bottom surface of the container 121.

While the above description details the preferred embodiments of the container, there are other embodiments that are anticipated by the Inventor. More specifically, the container can be any foldable container and need not be a cardboard box, nor does the container need to be a four-sided structure. In addition, just as the container need not have four side surfaces, it need not incorporate four to eight flaps. The container can have only one flap, no flap or even a separate lid. In addition, the strips of adhesive material do not have to be fixed to the side surfaces of the box in the locations shown in the figures. They could be placed anywhere on the side of the container regardless of whether they are positioned to overlap the free edges of the major flaps. In addition, each strip of adhesive material is generally made of packing tape, i.e., tape that is made of a polypropylene or polyester backing, but can be any number of adhesive materials including other types of tape like duct, electrical, acetate or masking tape.

Furthermore, it is worth noting, sealing the top and bottom surfaces of the foldable container is accomplished through identical means—that is to say, the top surface of the foldable container and the bottom surface of the same container are sealed in the same manner using the same structures.

The advantages of the present invention include, without limitation, the ability to purchase packing materials in the exact proportions or quantities needed to fulfill the user's purposes. In addition, the container makes storing packaging materials together very simple and convenient. The disclosed container creates a simple to use, single piece container available for packing tangible property. It also makes for a simpler means of opening a sealed foldable container. Moreover, the embodiments disclosed in this application represent a significantly more efficient way of transporting foldable containers with adhesive materials attached to them, without the strips of adhesive material becoming snagged or hung up or accidentally removed from the container during transport.

Reference throughout the specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout the specification may, but do not necessarily, refer to the same embodiment.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

It is understood that the above described embodiments are only illustrative of the application of the principles of the present invention. The present invention may be embodied in other specific forms without departing from its spirit or essential characteristics. The described embodiment, including the best mode, is to be considered in all respects only as illustrative and not restrictive. The scope of the invention is, therefore, indicated by the appended claims, if any, in conjunction with the foregoing description.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

I claim:

1. A container comprising:

an interior, an exterior, a plurality of side surfaces and a plurality of flaps attached to said side surfaces, wherein at least two of the plurality of flaps are major flaps connected to two of the plurality of side surfaces, respectively, and the major flaps have a length about equal to a length of the two of the plurality of side surfaces;

at least one release liner featured on a plurality of adjacent side surfaces of the container wherein the at least one release liner has a length longer than the length of the major flaps; and a strip of adhesive material releasably attached to the at least one release liner such that the strip of adhesive material can be placed anywhere on the container, wherein the strip of adhesive material is longer than the length of the major flaps.

2. The container of claim 1, wherein the at least one release liner is attached to a side surface of the foldable container.

3. The container of claim 1, wherein the at least one release liner is attached to a flap of the foldable container.

4. The container of claim 1, wherein the at least one release liner is attached to and extends partially across more than one of the side surfaces of the container.

5. The container of claim 1, where in the at least one release liner is attached to and extends partially across a side surface and a flap.

6. The container of claim 1, wherein the at least one release liner is attached to and extends entirely across more than one of the side surfaces of the container.

7. The container of claim 1, further comprising providing the container with at least two release liners and providing each release liner with a single strip of adhesive material.

8. The container of claim 7, wherein the at least two release liners are different sizes.

* * * * *